US005464324A

United States Patent [19]

Langenberg

[11] Patent Number: 5,464,324

[45] Date of Patent: Nov. 7, 1995

[54] VARIABLE-PITCH PROPELLER OR FAN

[76] Inventor: Klaas H. Langenberg, Forsbro Pl. 3283, 82010 Arbrå, Sweden

[21] Appl. No.: 236,041

[22] Filed: May 2, 1994

[51] Int. Cl.[6] ..... B63H 3/04

[52] U.S. Cl. ..... 416/167; 416/127; 416/129

[58] Field of Search ..... 416/163, 164, 416/167, 168 R, 168 A, 127, 147, 128, 129 R, 129 A; 440/50

[56] References Cited

U.S. PATENT DOCUMENTS

| | | | |
|---|---|---|---|
| 2,283,774 | 5/1942 | Thompson . | |
| 2,357,229 | 8/1944 | Seewer | 416/168 R |
| 2,776,719 | 1/1957 | Nichols | 416/167 |
| 3,295,610 | 1/1967 | Frids | 416/167 |

FOREIGN PATENT DOCUMENTS

| | | | |
|---|---|---|---|
| 2056975 | 9/1971 | Germany | 416/127 |
| 0097341 | 11/1960 | Norway | 416/168 R |
| 1603282 | 11/1981 | United Kingdom . | |

*Primary Examiner*—Edward K. Look
*Assistant Examiner*—Christopher Verdier
*Attorney, Agent, or Firm*—Young & Thompson

[57] ABSTRACT

A variable-pitch propeller or fan comprises a hollow boss, a number of propeller blades fitted rotatably on the boss, and also an adjusting element which is axially slidable in the boss and has a number of grooves running essentially at right angles to the direction of sliding, each propeller or fan blade having a control pin which is placed eccentrically relative to its rotary shaft and is slidingly accommodated in a groove of the adjusting element. In order to increase the range of adjustment each groove comprises an essentially straight part and also a second part connecting to the straight part and forming an angle with the essentially straight part.

8 Claims, 4 Drawing Sheets

VARIABLE-PITCH PROPELLER OR FAN

FIELD OF THE INVENTION

The invention relates to a variable-pitch propeller or fan, comprising a hollow boss, a number of propeller or fan blades fitted rotatably on the boss, and also an adjusting element which is axially slidable in the boss and has a number of grooves running essentially at right angles to the direction of sliding, each propeller blade having a control pin which is placed eccentrically relative to its rotary shaft and is slidingly accommodated in a groove of the adjusting element.

BACKGROUND OF THE INVENTION

A variable-pitch propeller of this kind for a ship is known from U.S. Pat. No. 3,853,427. The adjusting element used for it has a number of straight grooves running perpendicular to the direction of sliding of the adjusting element. When said adjusting element is slid, the propeller blades can be adjusted between a forward driving position, a neutral position in which the propeller blades produce no driving force, and a reverse driving position.

Although the propeller blades of this known propeller can be rotated through a considerable angle, it is not possible to move them into such a position that the blades produce a minimum resistance when the vessel is being propelled in another way. This occurs, for example, in the case of a sailing vessel which is propelled by the wind in such a way that the propeller can be put out of operation.

If, therefore, this known propeller is being used as an auxiliary drive for, for example, a sailing vessel, said propeller will have to be taken out of the water, in order to minimise the resistance during sail operation alone. Where there is an outboard motor, it is possible to do this, but once a fixed internal engine with a fixed propeller shaft is used this is no longer possible.

SUMMARY OF THE INVENTION

The object of the invention is therefore to provide a propeller of the type described above which can be placed in a position in which it gives the least possible resistance. This object is achieved through the fact that each groove of the adjusting element comprises an essentially straight part and also a second part connecting to the straight part and forming an angle with the first part.

So long as the control pin lies in the straight part of the groove, the adjusting mechanism acts in the known way. However, when the control pin has reached the second part, the propeller blade in question can be rotated further than is possible in the case of the known variable-pitch propeller. Making the groove a suitable shape in this case ensures that the desired position with minimal resistance in the forward direction is also achieved.

According to a preferred embodiment, the second part is curved and runs smoothly on from the first part. In the case of this embodiment, the groove has no abrupt angle changes. Such a gradual curve of the groove is important for a trouble-free performance of the adjusting mechanism.

If, in addition, the second part opens out at one of the axial ends of the adjusting element, the assembly or disassembly of the propeller can be considerably facilitated. The propeller blades inserted into the boss are set in such a rotary position that their control pin is situated opposite the mouth of the corresponding groove of the adjusting element. The adjusting element is then pushed up, in such a way that each control pin ultimately lies in the corresponding groove. Conversely, the control pins are easy to slide out of the grooves when the propeller is being disassembled.

In order to obtain the greatest possible angular displacement, the distance between the mouth of the groove and the other end of the groove is at least equal to the length of the lever arm between the control pin and the rotary shaft.

Although the description before is mainly related to a propeller for a ship, the invention is not limited to such application. It is also possible to apply the invention to an adjustable ventilator fan. The angular position of the fan blades can then be controlled in several ways, for instance by a servo-motor on the basis of measurements carried out in the flow generated by the ventilator fan.

BRIEF DESCRIPTION OF THE DRAWINGS

The invention will be explained in greater detail with reference to an example of an embodiment shown in the figures.

DETAILED DESCRIPTION OF THE INVENTION

Figure 1:
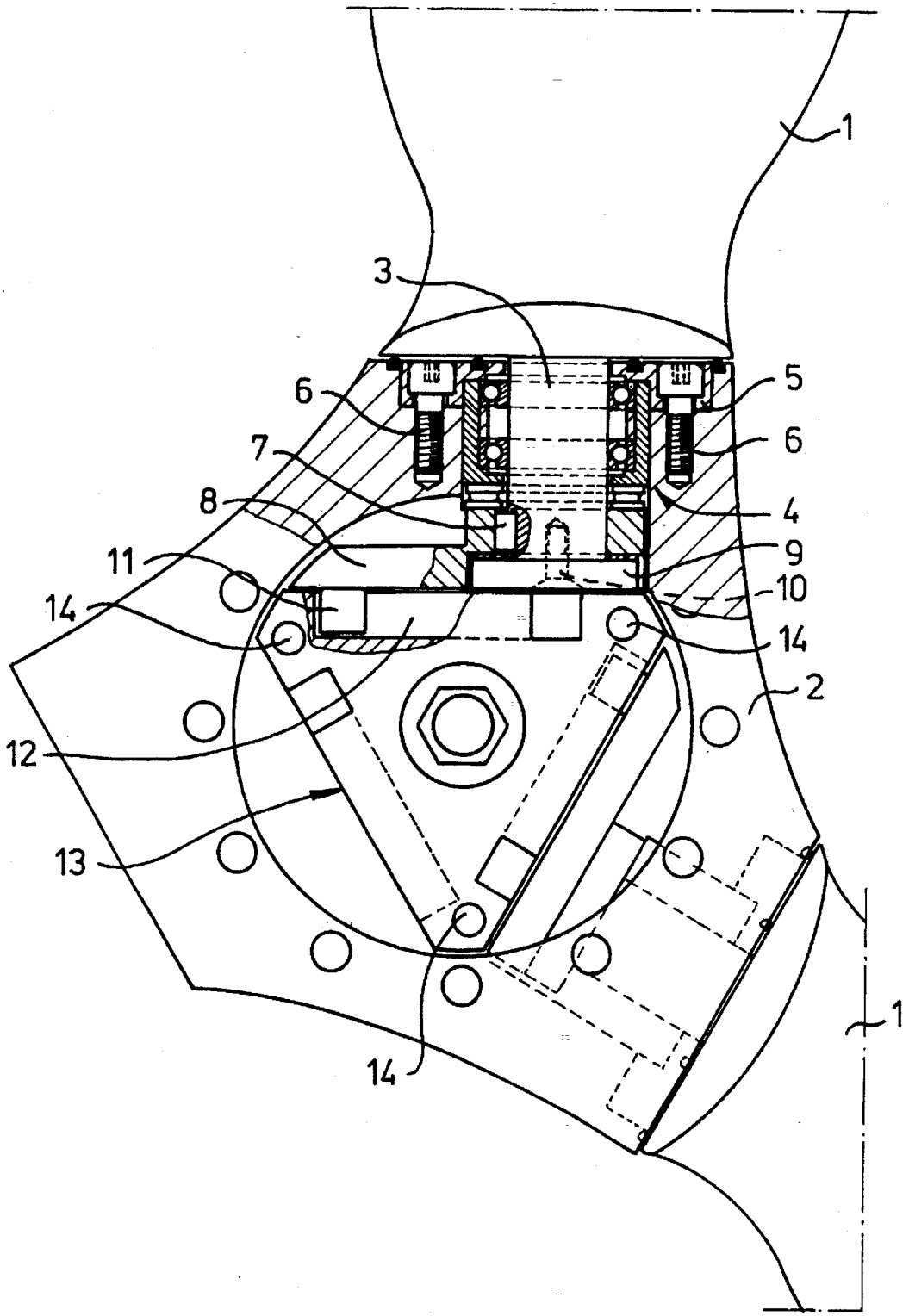
FIG. 1 shows a rear view, partially in cross-section, of the propeller according to the invention.
Figure 2:
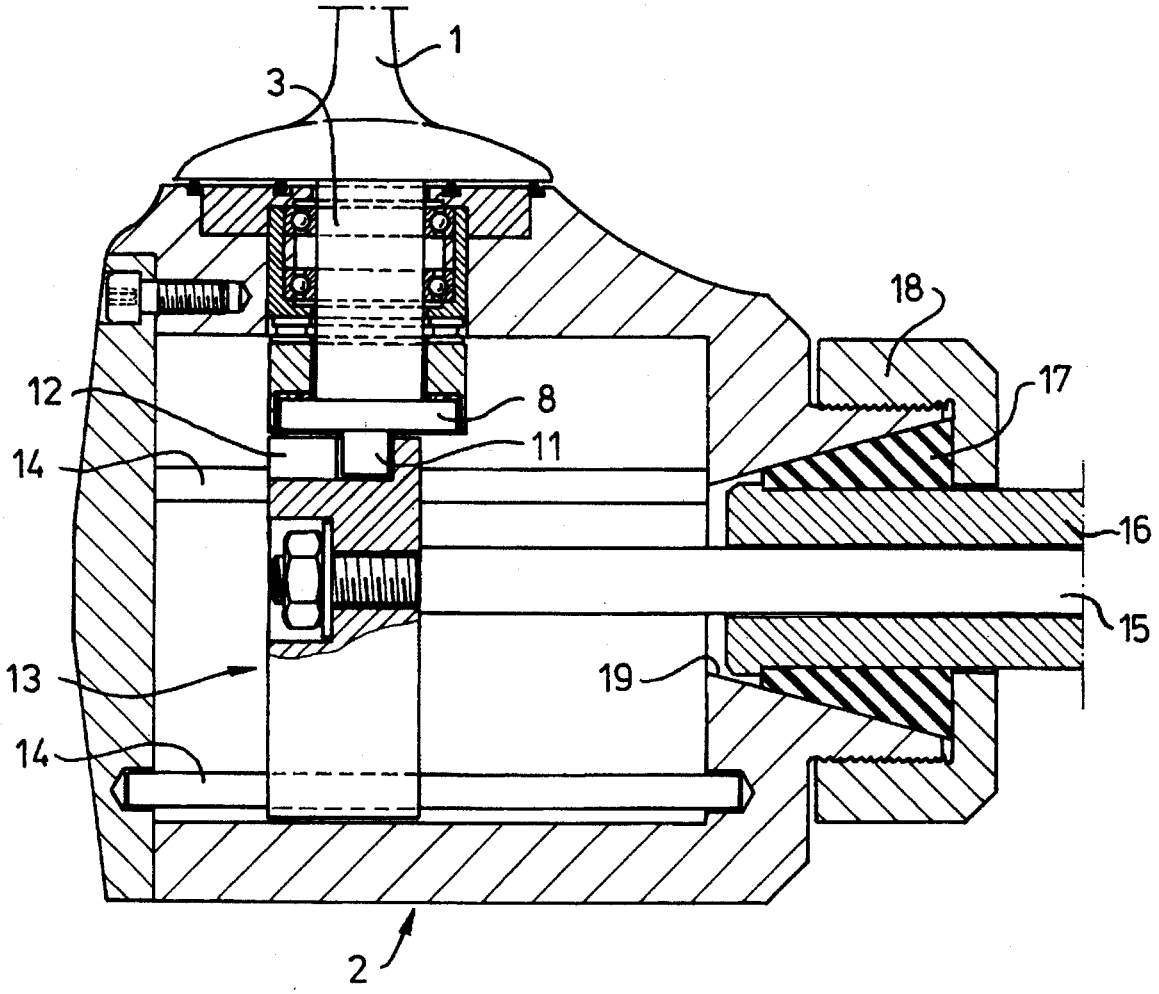
FIG. 2 shows a side view, partially in cross-section.

The propeller according to the invention shown in the figures comprises three propeller blades 1 which are rotatably connected to a boss 2. For this purpose, each propeller 1 has a rotary pin 3 which is rotatable in the bearing construction 4. This bearing construction is held in place in the boss 2 by means of fixing ring 5 and bolts 6.

At its end facing away from the propeller blade 1, the rotary pin 3 is connected to control arm 8 by means of key 7. This control arm 8 is held in position on the control pin 3 by means of fixing plate 9 and screw 10.

The control arm 8 has a control pin 11, which is accommodated in groove 12 of the adjusting element, which is indicated in its entirety by 13. The adjusting element includes several holes running in the axis of rotation of the boss, and is slidably guided on the guide rods 14. These guide rods which run through the holes are in turn fixed in the boss 2. The adjusting element is located within a cavity of the boss, and is driven by means of adjusting rod 15, which runs through the hollow drive shaft 16 of the propeller. This drive shaft 16 is fixed in the conical hole 19 of the boss 2 by means of cone 17 and screw ring 18.

Figure 3:
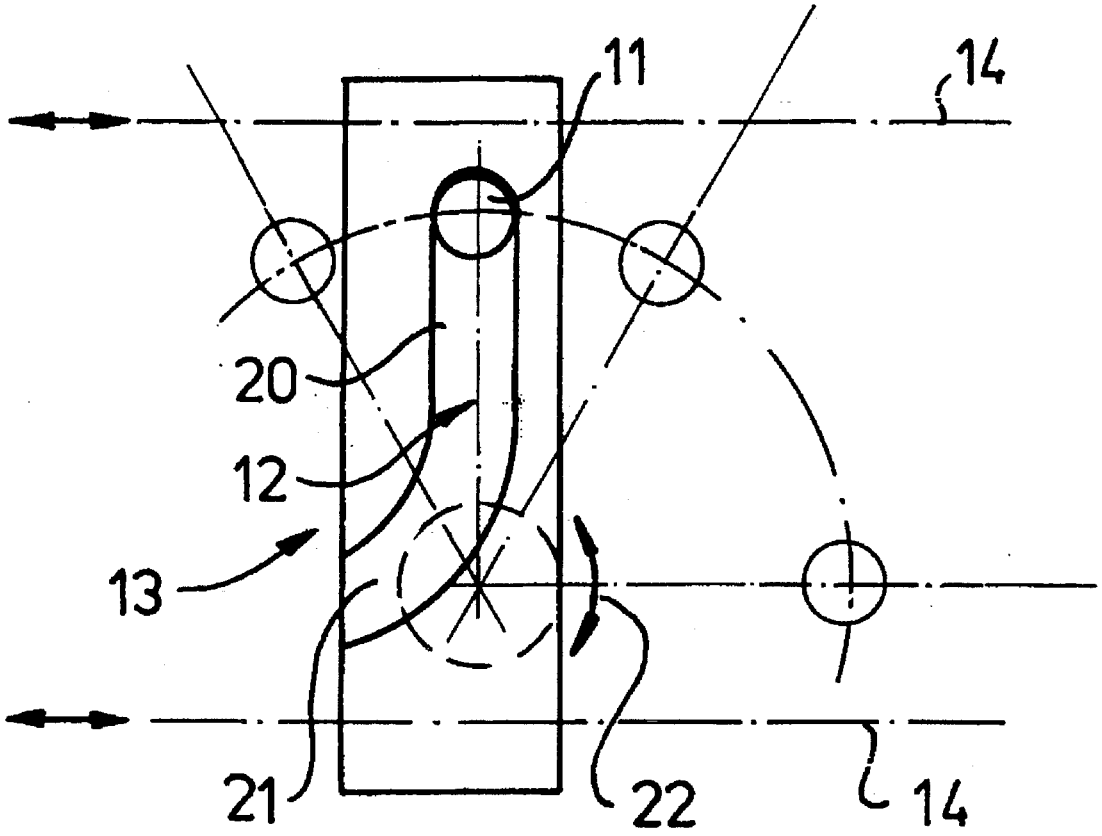
FIG. 3 shows a detail of the adjusting element.

As can be seen in FIG. 3, which constitutes a view of one of three faces of the adjusting element 13, the groove 12 has both a straight part 20 and a curved part 21. When the adjusting element 13 is slid over the diagrammatically shown guide rods 14, the control pin 11 describes the circular path shown by dashed lines.

The position of the control pin 11 shown in FIG. 3 corresponds to the neutral position of the corresponding propeller blade, in other words, said blade exerts no driving force if it is rotated. When adjusting element 13 is moved to the left in FIG. 3, the control pin 11 reaches a position in which the blade produces a backward driving force; when adjusting element 13 is moved to the right, the control pin 11 reaches a position in which the blade produces its forward driving force.

In this case the propeller makes a rotary movement which is diagrammatically shown by means of arrow 22.

The adjusting element 13 according to the invention can now be moved so far to the right that the control pin 11 reaches a position in which the corresponding propeller blade is rotated through 90° relative to the neutral position. In that position the propeller blade is pointing in the lengthwise direction of the ship, in which position the propeller produces the smallest possible resistance if the ship is being driven by, for example, wind power.

This position can be achieved because of the curved shape of the part 21 of the groove 12. When the adjusting element 13 is subsequently moved to the left again, the control pin 11 can be moved back again to the neutral position.

It should be noted that although the figures are related to an embodiment of a propeller having three blades for a ship, other suitable numbers of blades could be applied as well. For instance, in case the invention is applied in the field of ventilator fans a number of 6 or 8 blades is quite possible as well.

Figure 4:
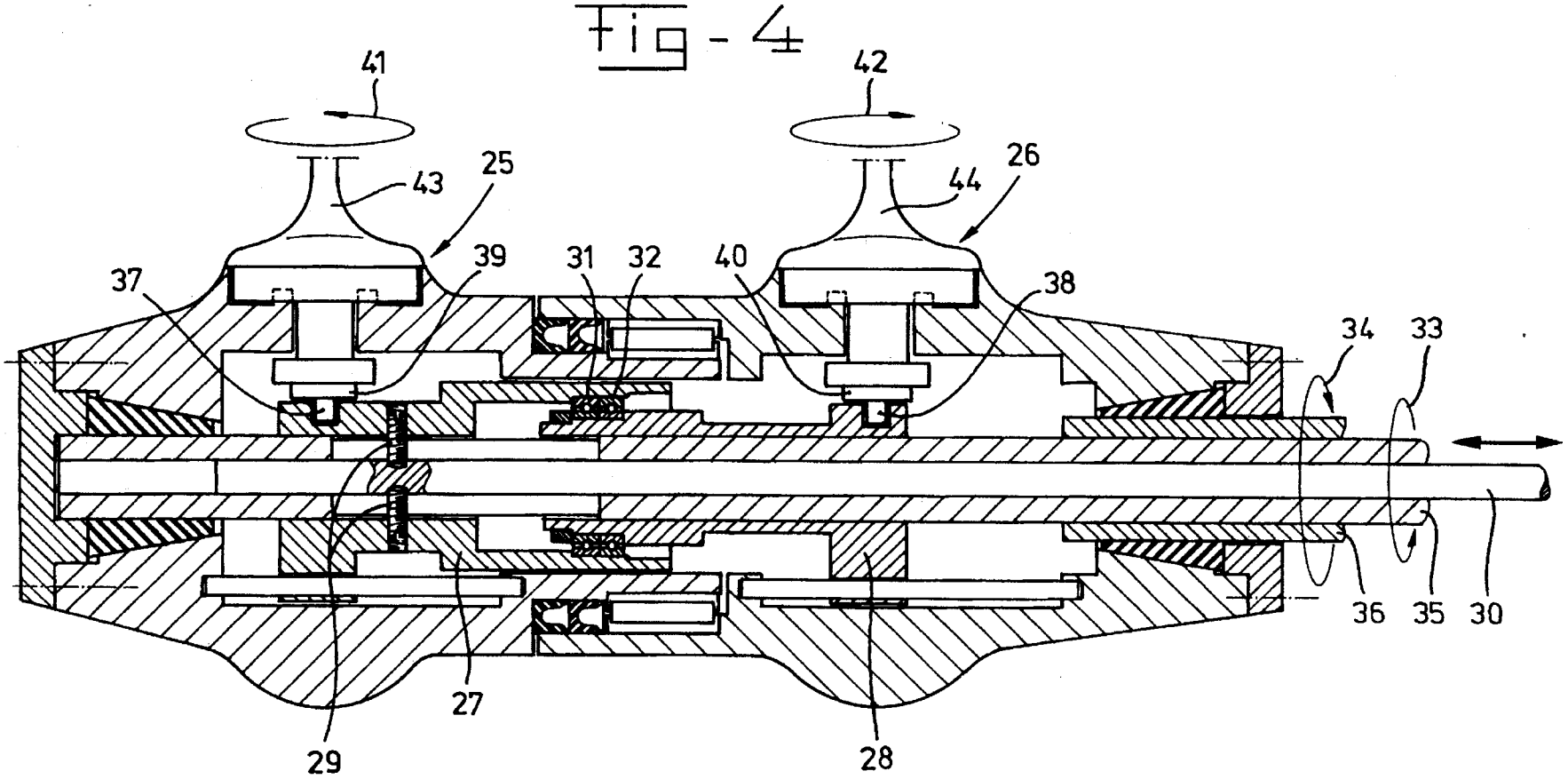
FIG. 4 shows a propulsion unit with two propellers.

The propulsion unit shown in FIG. 4 has two propellers 25, 26, each with their own adjusting element 27, 28. Adjusting element 27 is, by means of screws 29, connected to adjusting rod 30. By means of bearings 31, 32, adjusting elements 27, 28 are coupled in an axial direction. However, they are not coupled in a rotational direction.

Propellers 25, 26 can be rotated in opposite senses 33 and 34, by means of drive shafts 35 and 36 and still their respective adjusting elements 27, 28 can travel in unison an axial direction.

Moreover, their control pins 37, 38 are connected to control arms 39, 40 which, in a cross-section, point away from each other, leading to rotations 41, 42 of blades 43, 44 in opposite senses.

Although the embodiment shown in FIG. 4 is related to propellors for ships it is also possible to apply this arrangement in a double ventilator fan or a wind mill with two fans.

I claim:

1. Propulsion unit comprising two variable-pitch propellers, each of said propellers having a hollow boss, a number of propeller blades fitted rotatably on the boss, and an adjusting element which is axially slidable in the boss and has a number of grooves running essentially at right angles to the direction of sliding, each propeller blade having a rotary shaft and a control pin which is placed eccentrically relative to its rotary shaft and is slidingly accommodated in one of said grooves of the adjusting element, whereby the propeller blades are adjustable between a forward driving position, a neutral position, and a reverse position, each groove having an esentially straight part and a second part connecting to the straight part and forming an angle with the essentially straight part.

2. Variable-pitch propeller comprising a hollow boss, a number of propeller blades fitted rotatably on the boss, and an adjusting element which is axially slidable in the boss and has a number of grooves running essentially at right angles to the direction of sliding, each propeller blade having a rotary shaft and a control pin which is placed eccentrically relative to its rotary shaft and is slidingly accommodated in one of said grooves of the adjusting element, whereby the propeller blades are adjustable between a forward driving position, a neutral position, and a reverse driving position, each groove having an essentially straight part and a second part connecting to the straight part and forming an angle with the essentially straight part.

3. Propeller according to claim 2, wherein the second part is curved and runs smoothly on from the first part.

4. Propeller according to claim 3, wherein the adjusting element has axial ends, the straight part of the groove running essentially perpendicular to the direction of sliding, and the curved part of the groove running in the direction of one of the axial ends.

5. Propeller according to claim 4, wherein the second part has a mouth which widens out at one of the axial ends of the adjusting element.

6. Propeller according to claim 5, wherein the distance between the mouth of the groove and the other end of the groove is at least equal to the length of a lever arm between one of the control pins and one of the rotary shafts.

7. Propeller according to claim 2, wherein the adjusting element is accommodated in a cavity of the boss, said adjusting element includes means for connecting it to an adjusting rod running through a hollow drive shaft for the propeller.

8. Propeller according to claim 2, wherein the adjusting element includes at least two holes running in the direction of rotation of the boss, said boss including at least two bearing rods running through said holes.

* * * * *